US007298985B2

(12) United States Patent
Nihonyanagi et al.

(10) Patent No.: US 7,298,985 B2
(45) Date of Patent: Nov. 20, 2007

(54) IMAGE-FORMING APPARATUS AND IMAGE-FORMING METHOD

(75) Inventors: Koji Nihonyanagi, Susono (JP); Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/169,787

(22) Filed: Jun. 30, 2005

(65) Prior Publication Data

US 2006/0008286 A1 Jan. 12, 2006

(30) Foreign Application Priority Data

Jul. 6, 2004 (JP) ..... 2004-199411

(51) Int. Cl.
*G03G 15/20* (2006.01)

(52) U.S. Cl. ..... 399/69

(58) Field of Classification Search ..... 399/69
See application file for complete search history.

(56) References Cited

U.S. PATENT DOCUMENTS

| | | | | |
|---|---|---|---|---|
| 5,149,941 | A | 9/1992 | Hirabayashi et al. | 219/216 |
| 5,262,834 | A | 11/1993 | Kusaka et al. | 355/285 |
| 6,713,725 | B2 | 3/2004 | Izawa et al. | 219/216 |
| 6,748,192 | B2 | 6/2004 | Izawa et al. | 399/329 |
| 6,763,205 | B2 | 7/2004 | Izawa et al. | 399/69 |
| 6,787,737 | B2 | 9/2004 | Uekawa et al. | 219/216 |
| 6,794,611 | B2 | 9/2004 | Kataoka et al. | 219/216 |
| 6,862,416 | B2 | 3/2005 | Hashiguchi et al. | 399/69 |
| 6,920,293 | B2 | 7/2005 | Izawa et al. | 399/67 |
| 6,944,420 | B2 | 9/2005 | Kanamori et al. | 399/329 |
| 6,952,538 | B2 | 10/2005 | Hashiguchi et al. | 399/45 |
| 6,965,742 | B2 | 11/2005 | Miyamoto et al. | 399/50 |
| 2002/0003970 | A1* | 1/2002 | Goto et al. | 399/69 |
| 2005/0169656 | A1 | 8/2005 | Nihonyanagi et al. | 399/69 |
| 2005/0191070 | A1 | 9/2005 | Izawa et al. | 399/44 |
| 2005/0191075 | A1 | 9/2005 | Kimizuka et al. | 399/69 |
| 2005/0201788 | A1 | 9/2005 | Kubochi et al. | 399/381 |
| 2005/0207770 | A1 | 9/2005 | Nihonyanagi et al. | 399/67 |

(Continued)

FOREIGN PATENT DOCUMENTS

| | | |
|---|---|---|
| JP | 63-313182 | 12/1988 |

(Continued)

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

In an image-forming apparatus, a temperature sensor is situated in the position where the sensor is insusceptible to steam. The position is, for example, a portion, of a discharge-sensor lever, where a printing material abuts on the discharge-sensor lever. Accordingly, the temperature sensor becomes insusceptible to steam, whereby the image-forming apparatus can more appropriately control the fixing temperature than conventional image-forming apparatuses. In other words, the image-forming apparatus can more reduce the incidence rate of defects, such as increase, due to excess heating, in the amount of hot-offsets and curls, deterioration of loading capacity, and defective fixing due to scarcity of the amount of heat, than the conventional image-forming apparatuses. Moreover, by determining a threshold temperature every time when a printing material passes through a heat-fixing unit, a problem can be alleviated, in which, at the beginning of a series of paper passage, the amount of fluctuation in detected temperature becomes significantly large.

7 Claims, 18 Drawing Sheets

U.S. PATENT DOCUMENTS

| | | | | |
|---|---|---|---|---|
| 2005/0244200 | A1 | 11/2005 | Kanamori et al. | 399/333 |
| 2006/0056891 | A1 | 3/2006 | Hashiguchi et al. | 399/329 |

FOREIGN PATENT DOCUMENTS

| | | | | |
|---|---|---|---|---|
| JP | 2-157878 | | | 6/1990 |
| JP | 4-44074 | | | 2/1992 |
| JP | 7-230231 | | | 8/1995 |
| JP | 07230231 | A | * | 8/1995 |
| JP | 200113816 | A | * | 1/2001 |

* cited by examiner

FIG. 10

| NUMBER OF SHEETS PRINTED OUT | THRESHOLD VALUE S1 (C°) | THRESHOLD VALUE S2 (C°) |
|---|---|---|
| 1 | 37 | 55 |
| 2 | 42 | 60 |
| 3 | 44 | 62 |
| 4-6 | 47 | 65 |
| 7-9 | 50 | 68 |
| 10-15 | 52 | 70 |
| 16-20 | 53 | 71 |
| 21-30 | 54 | 72 |
| 31- | 55 | 73 |

FIG. 11

| | EXAMPLE | | | COMPARATIVE EXAMPLE | | |
|---|---|---|---|---|---|---|
| TYPE OF PAPER | THIN PAPER A | THIN PAPER B | ROUGH PAPER C | THIN PAPER A | THIN PAPER B | ROUGH PAPER C |
| NUMBER OF SHEETS HAVING HOT-OFFSET | 0 | 0 | 0 | 32 | 0 | 0 |
| NUMBER OF SHEETS HAVING DEFECTIVE FIXING | 0 | 0 | 0 | 0 | 0 | 8 |

FIG. 15

| NUMBER OF SHEETS PRINTED OUT | THRESHOLD VALUE S1 (C°) | THRESHOLD VALUE S2 (C°) |
|---|---|---|
| 1 | 42 | 60 |
| 2 | 47 | 65 |
| 3 | 49 | 67 |
| 4-6 | 52 | 70 |
| 7-9 | 55 | 73 |
| 10-15 | 57 | 75 |
| 16-20 | 58 | 76 |
| 21-30 | 59 | 77 |
| 31- | 60 | 78 |

FIG. 16

| NUMBER OF SHEETS PRINTED OUT | THRESHOLD VALUE S1 (C°) | THRESHOLD VALUE S2 (C°) |
|---|---|---|
| 1 | 37 | 55 |
| 2 | 42 | 60 |
| 3 | 44 | 62 |
| 4-6 | 47 | 65 |
| 7-9 | 50 | 68 |
| 10-15 | 52 | 70 |
| 16-20 | 53 | 71 |
| 21-30 | 54 | 72 |
| 31- | 55 | 73 |

FIG. 17

| NUMBER OF SHEETS PRINTED OUT | THRESHOLD VALUE S1 (C°) | THRESHOLD VALUE S2 (C°) |
|---|---|---|
| 1 | 32 | 50 |
| 2 | 37 | 55 |
| 3 | 39 | 57 |
| 4-6 | 42 | 60 |
| 7-9 | 45 | 63 |
| 10-15 | 47 | 65 |
| 16-20 | 48 | 66 |
| 21-30 | 49 | 67 |
| 31- | 50 | 68 |

FIG. 18

| | ENVIRONMENT | HIGH-TEMPERATURE ENVIRONMENT | | NORMAL-TEMPERATURE ENVIRONMENT | | LOW-TEMPERATURE ENVIRONMENT | |
|---|---|---|---|---|---|---|---|
| | TYPE OF PAPER | THIN PAPER A | ROUGH PAPER C | THIN PAPER A | ROUGH PAPER C | THIN PAPER A | ROUGH PAPER C |
| EXAMPLE | NUMBER OF SHEETS HAVING HOT-OFFSET | 0 | 0 | 0 | 0 | 0 | 0 |
| | NUMBER OF SHEETS HAVING DEFECTIVE FIXING | 0 | 0 | 0 | 0 | 0 | 0 |
| COMPARATIVE EXAMPLE | NUMBER OF SHEETS HAVING HOT-OFFSET | 38 | 0 | 0 | 0 | 0 | 0 |
| | NUMBER OF SHEETS HAVING DEFECTIVE FIXING | 0 | 0 | 0 | 0 | 0 | 25 |

IMAGE-FORMING APPARATUS AND IMAGE-FORMING METHOD

FIELD OF THE INVENTION

The present invention relates to image-forming apparatuses, and particularly to a control technology for fixing-temperature, in heat-fixing a non-fixed image made of a developing material.

BACKGROUND OF THE INVENTION

In general, in image-forming apparatuses adopting electrophotographic-method, such as a printer, a copy machine, and a facsimile machine, by forming a developing-material image (a toner image) on a printing material, and by melting and fixing the toner image, through heating and pressure processing, on the printing material, an image is formed.

Meanwhile, the types of printing materials utilized for these image-forming apparatuses include a wide variety of materials such as normal paper, high-quality paper onto which special surface processing is applied, resin-made sheets for OHPs. Furthermore, because the image-forming apparatuses have spread all over the world, the types of printing materials utilized for image-forming have rapidly been increasing in number. Therefore, the image-forming apparatuses are expected to be able to form good images with various types of printing materials being utilized in each region.

Thermal-resistance difference due to difference in surface property exists between a printing material, to be used, having a smooth surface (referred to as smooth paper, hereinafter) and a printing material having a rough surface (referred to as rough paper, hereinafter). Heating efficiency from a heating source in a heat-fixing unit to the surface of a sheet of paper differs depending on the thermal-resistance difference. For example, even though fixing is applied to rough paper at a temperature appropriate to smooth paper, insufficient fixing is caused. This is because fixing to rough paper requires a higher temperature than that required by fixing to smooth paper. Therefore, in current apparatuses, a temperature at which a toner image can sufficiently be fixed even on rough paper is utilized as a standard fixing temperature.

However, with these apparatuses, fixing to smooth paper is always implemented at excess temperature; therefore, a hot-offset problem occurs. Furthermore, the fixing temperature is too low for paper that is rougher than rough paper, whereby a problem of defective fixing also occurs. A further higher temperature is required for such paper. Conventionally, utilizing such paper has inconvenienced the user, because the user has to manually change the setting for fixing temperature.

In addition, as a fixing apparatus that is provided in an image-forming apparatus adopting the electrophotographic-method, so-called heat-roller-system heat-fixing units have widely been utilized. In the heat-roller system, by making a printing material carrying a non-fixed toner image pass through a nip portion, the toner image is fixed as a permanent image on the printing material. The nip portion is formed with a fixing roller and a pressure roller that rotate being pressed by each other.

Meanwhile, from the recent viewpoint of energy-saving promotion, a fixing method has been proposed, in which, without supplying a fixing unit in a standby mode with electric power, power consumption is suppressed as much as possible. In this method, a system in which a toner image on a printing material is fixed through a small thin film, having small heat capacity, interposed between a heater portion and a pressure roller, i.e., a so-called film-heating system, has been employed (Japanese Patent Laid-Open No. 63-313182, No. 2-157878, and No. 4-44074).

A fixing unit employing the film-heating system has been drawing attention, because of its higher heat-transfer efficiency and shorter start-up time than those of units employing the heat-roller-system. In addition, the film-heating system has been applied also to high-speed models.

However, in this system, heat-up speed is emphasized; thus, it is necessary to diminish the heat capacity of the heating surface of a fixing portion. Making the heat capacity of the heating surface small hinders the formation of an elastic layer on the heating surface. Therefore, in effect, a hard heating surface has been utilized. If the heating surface is hard, difference in heating efficiency is liable to occur, due to unevenness of the surface of a printing material.

Therefore, a method has been proposed, in which the fixing temperature is automatically switched to an optimal temperature, by detecting the heat capacity and the surface roughness, of a printing material (Japanese Patent Laid-Open No. 7-230231). Specifically, by measuring through a non-contact temperature-detecting sensor the temperature of a printing material, the fixing temperature is set to an optimal value, based on the measured temperature. Accordingly, for thin paper, which is readily heated, by reducing the fixing temperature, a curl and a hot-offset can be prevented. In addition, in the case of a printing material having a rough surface, or thick paper, by raising the fixing temperature, sufficient fixing ability can be obtained.

However, in the foregoing related arts, because a non-contact temperature sensor is utilized, the temperature of a printing material can not accurately be detected. This is because the surface of the non-contact temperature sensor is fogged with steam. The steam is produced because, when the printing material is heated and fixed, moisture included in the printing material is concurrently heated.

It is assumed that, by forming an air path and the like, by means of a fan, steam does not fog the surface of the non-contact temperature sensor. In this case, a new defect may be caused, in which the air path also affects the surface temperature of the printing material. For that reason, the method, of determining types of printing materials, that utilizes a non-contact temperature sensor such as an infrared-ray sensor has not been practiced in effect.

Therefore, it is an object of the present invention to solve such and other issues. In addition, other issues may be understood by reading through the entire specification.

SUMMARY OF THE INVENTION

In the present invention, in an image-forming apparatus, a temperature sensor is situated in a position where the sensor is insusceptible to steam. The position is, for example, a portion, of a printing-material discharge sensor, where a printing material abuts on the printing-material discharge sensor. Accordingly, the temperature sensor becomes insusceptible to steam, whereby the image-forming apparatus can more appropriately control the fixing temperature than conventional image-forming apparatuses. In other words, the image-forming apparatus can more reduce the incidence rate of defects, such as increase, due to excess heating, in the amount of hot-offsets and curls, deterioration of loading capacity, and defective fixing due to scarcity of the amount of heat, than the conventional image-forming apparatuses.

Moreover, by determining a threshold temperature every time when a printing material passes through a heat-fixing unit, a problem can be alleviated, in which, at the beginning of a series of paper passage, the amount of fluctuation in detected temperature becomes significantly large.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 10 is a view representing an example of a threshold-value table according to First Embodiment;

FIG. 11 is a view illustrating results of experiments for confirming effects, of the present invention, according to First Embodiment;

FIG. 15 illustrates a threshold-value table for a high-temperature environment;

FIG. 16 illustrates a threshold-value table for a normal-temperature environment;

FIG. 17 illustrates a threshold-value table for a low-temperature environment; and FIG. 18 is a table illustrating results of the experiments with regard to Example and Comparative Example.

DETAILED DESCRIPTION OF THE PREFERRED EMBODIMENTS

Preferred embodiments of the present invention will now be described in detail in accordance with the accompanying drawings.

First Embodiment

Figure 1:
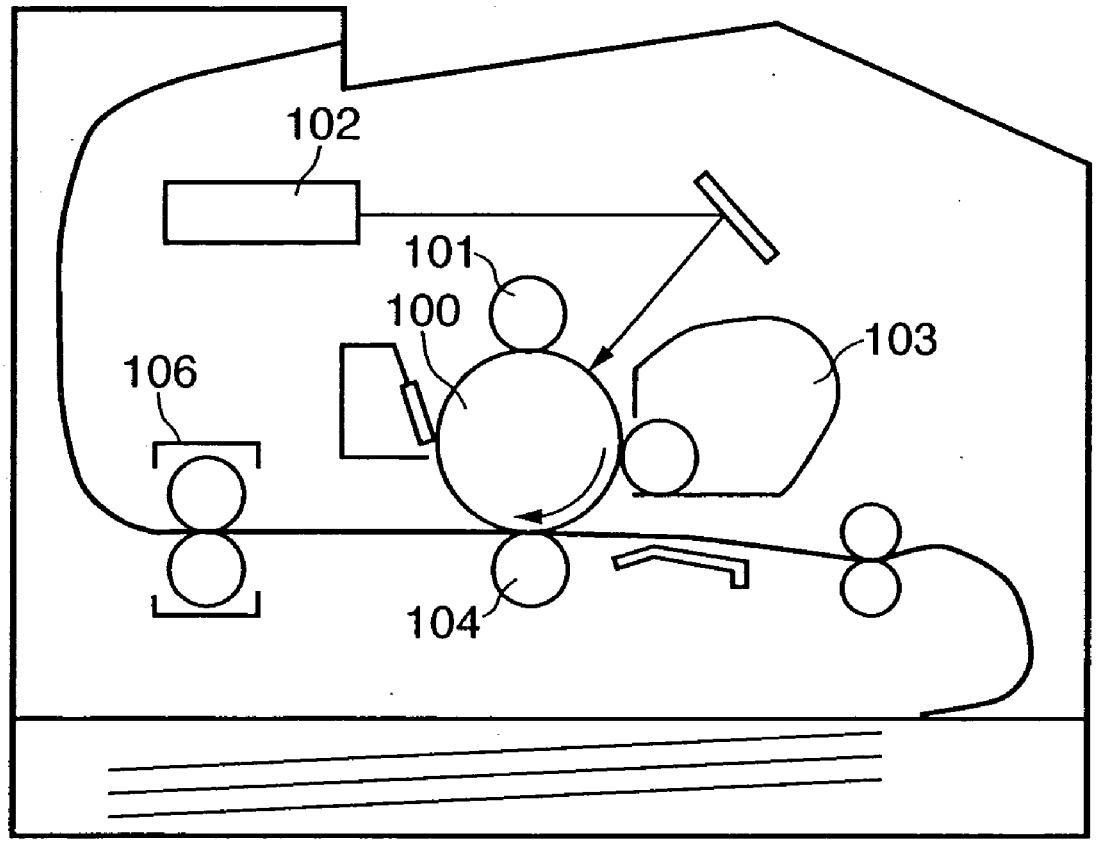
FIG. 1 is a view illustrating an example of an image-forming apparatus according to First Embodiment.

FIG. 1 is a view illustrating an example of an image-forming apparatus according to First Embodiment. Reference numeral 100 denotes a photoconductive drum; photosensitive materials, such as OPC, amorphous Se, and amorphous Si, are formed on a cylinder-like substrate made of aluminum, nickel, or the like. The photoconductive drum 100 is driven to rotate in the direction indicated by an arrow. The surface of the photoconductive drum 100 is uniformly charged by a charging roller 101 as a charger. A laser beam unit 102 forms an electrostatic latent image on the photoconductive drum 100, by scanning and exposing the photoconductive drum 100, with a laser beam being ON/OFF controlled in response to image information. The electrostatic latent image is developed and visualized by a developing unit 103. As a developing method, for example, jumping development, two-component development, FEED development, or the like is utilized. In addition, the combination of image exposure and reversal development is often utilized.

A transfer roller 104 as a transfer unit transfers the toner image visualized on the photoconductive drum 100 onto a printing material that is transported at a predetermined timing. The printing material that has been transported at the predetermined timing is transported being sandwiched, with a constant pressure force, between the photoconductive drum 100 and the transfer roller 104. The printing material onto which the toner image has been transferred is transported to a heat-fixing unit 106, and is fixed as a permanent image.

Figure 2:
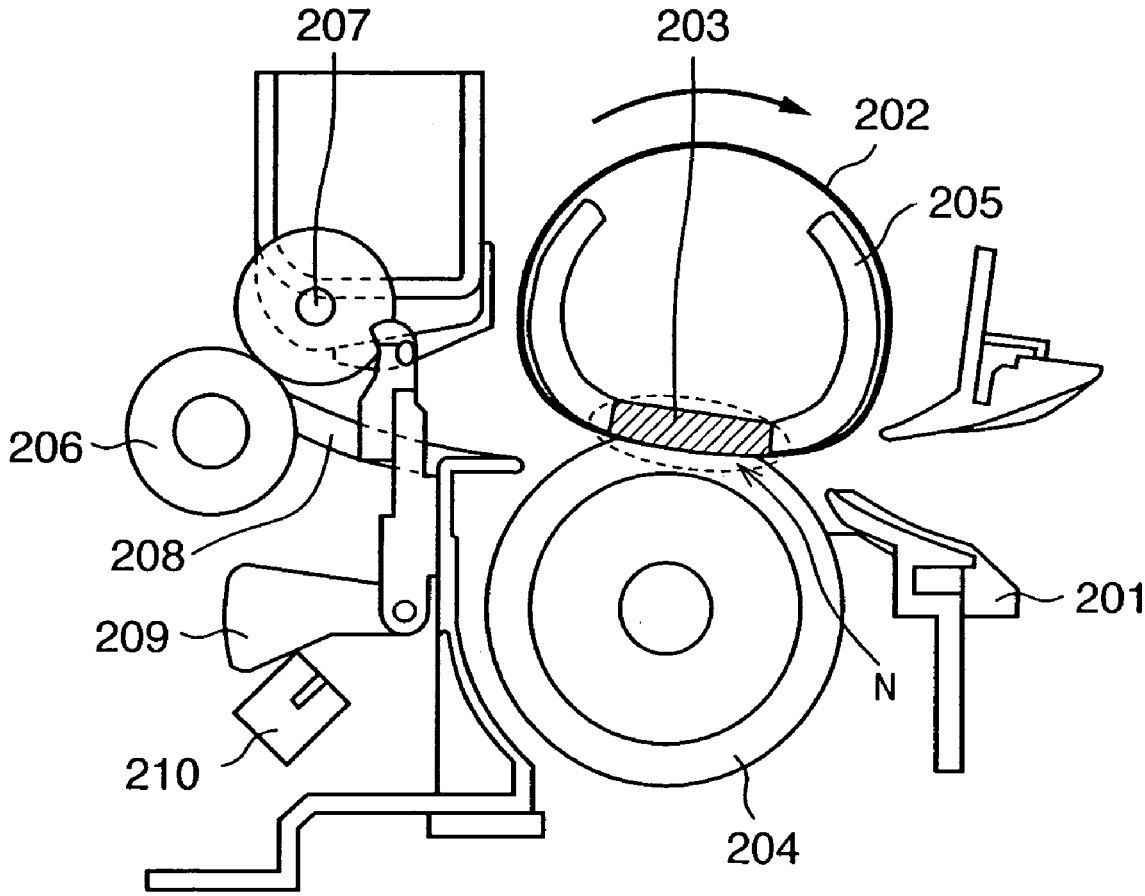
FIGS. 2 to 4 are cross-sectional views each illustrating an example of a heat-fixing unit according to First Embodiment.
Figure 3:
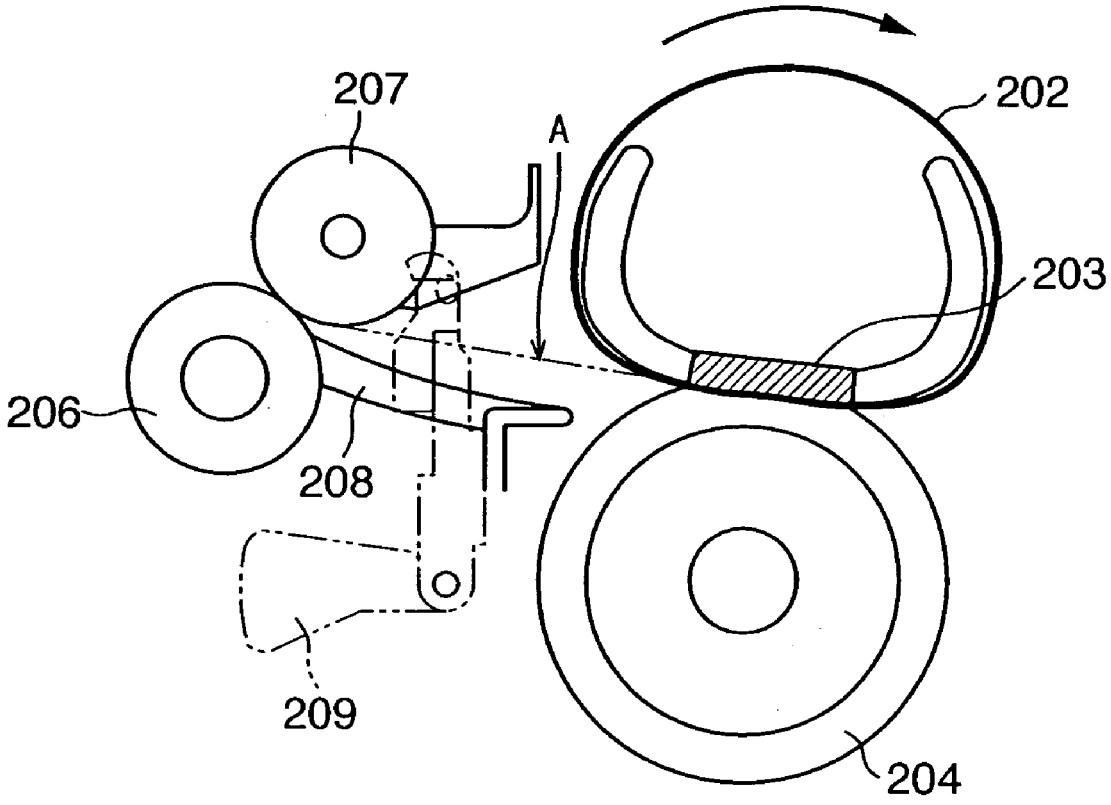
Figure 4:
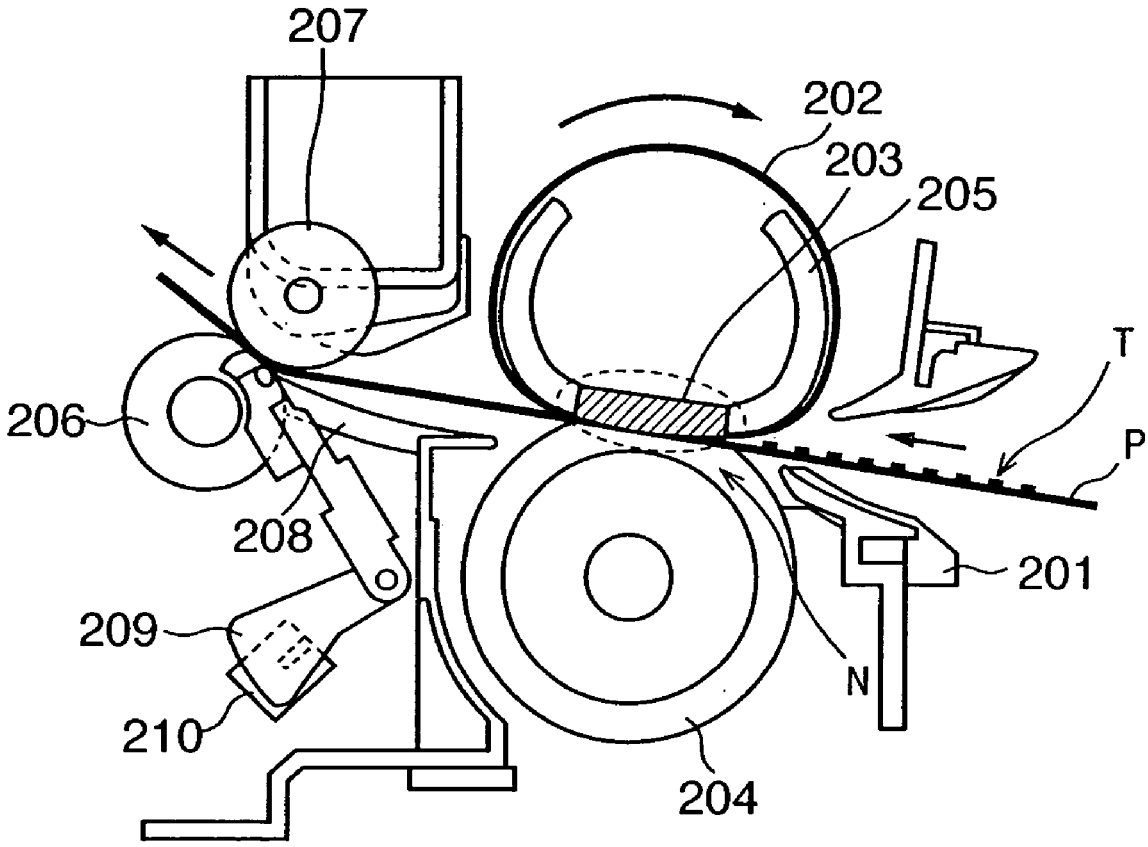
Figure 5:
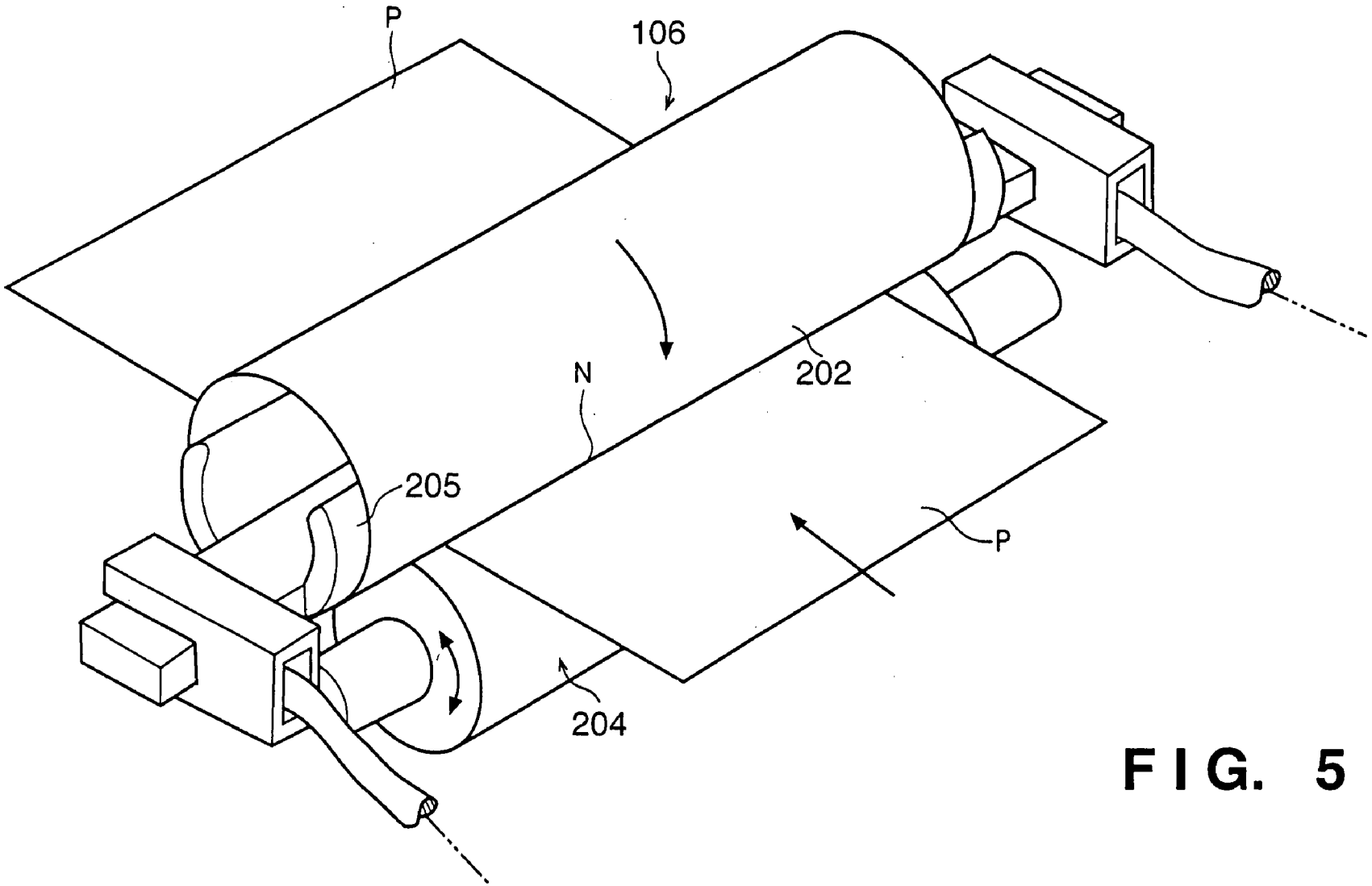
FIG. 5 is a perspective view illustrating an example of a heat-fixing unit according to First Embodiment.

FIGS. 2 to 4 are cross-sectional views each illustrating an example of a heat-fixing unit according to First Embodiment. FIG. 5 is a perspective view illustrating an example of a heat-fixing unit according to First Embodiment. A printing material P is transported to the heat-fixing unit 106, after the toner image T has been developed and transferred thereon, in an image-forming portion made up of the photoconductive drum 100, the transfer roller 104, and the like. As illustrated in FIG. 2, the front edge of the printing material P is led by a fixing-entrance guide 201 to a press-contact nip portion N. The press-contact nip portion N is formed with a thin-wall fixing film 202, and a heating body 203 and a pressure roller 204 that are arranged in such a way that the thin-wall fixing film 202 is sandwiched between them.

The fixing film 202 is a rotating body, for heating, that is thin-wall, flexible, and endless-belt. A release layer is formed as the surface layer of the fixing film 202. As can be seen from FIG. 2, the fixing film 202 whose circumferential length is longer than that of a semicircle-arch-like film guide 205 is loosely wrapped around the film guide 205.

The fixing film 202 should have a small heat capacity to raise its quick start-up ability. For example, the wall thickness may be 100 μm or less, preferably, between 20 μm and 60 μm, in total, and a heat-resistant resin film such as polyimide and PEEK, or a metal film such as a Ni electroformed film and a stainless-and-seamless film, may be utilized. In the case of a metal film, the heat conductivity is high, whereby it is sufficiently usable when its thickness is 150 μm or less.

Reference numeral 204 is a pressure roller, as a rotating body for applying pressure, that has a silicon-rubber layer on a core metal, such as iron and aluminum, and a PFA-tube layer, as a release layer, on the silicon-rubber layer.

At least when image fixing is implemented, the fixing film 202 is pivotally driven through the pivotal drive of the pressure roller 204, in the clockwise direction as indicated by an arrow, at a predetermined peripheral velocity, and without getting wrinkled. The predetermined peripheral velocity is approximately the same as the transport speed for the printing material P, carrying the non-fixed toner image, that is transported from the image-forming portion. In this situation, the fixing film 202 rotates, while abutting and sliding on the surface of the heating body (a heater for heating).

As the heating body 203, for example, a ceramic heater can be employed. A ceramic heater includes an electroconductive heating element (resister heating element) as a heat source that generates heat by being supplied with electric power, and is heated up through heat generation of the electroconductive heating element. The heating body 203 has a substrate made of alumina ($Al_2O_3$) or aluminum nitride (AlN). On the substrate, a heating-element pattern having a desired resistance value is formed. The heating-element pattern is formed by printing as a thick film on the substrate a resister made up of silver, palladium, and the like. Moreover, as a protective layer and as a sliding layer for the fixing film, a glass layer may be formed on the heating element.

By means of a thermistor, as a temperature-detecting element, that is fixed being attached on the opposite side of the surface on which the heating element is formed, the temperature of the heater is monitored. The monitored temperature information is inputted to a control-circuit unit described later. In order to maintain a predetermined heater temperature (the temperature of a fixing nip portion), the control-circuit unit controls the amount of electric power with which the AC power source supplies the heating element of the heating body, by controlling an AC-power driver.

In the situation that the heating body is heated through the power supply to the electroconductive heating element, and the fixing film is being pivotally driven, when a printing material is introduced into the press-contact nip portion (fixing nip portion) formed between the heating body and the pressure roller, due to elastic force caused by the deformation of the elastic layer of the pressure roller, the printing material passes through the fixing nip portion N, while abutting on the fixing film.

While the printing material P passes through the fixing nip portion N, thermal energy is applied from the heating body 203 to the printing material P via the fixing film 202; in consequence, a non-fixed toner image is heated, melted, and fixed on the printing material P. After passing through the fixing nip portion N, the printing material P is discharged being separated from the fixing film 202 and is transported to a discharging portion by means of discharging rollers 206 and 207.

In the image-forming apparatus according to First Embodiment, temperature-detecting means made up of a heat-collecting plate and a temperature-detecting sensor is provided in a printing-material discharge sensor disposed in the printing-material transporting path from the heat-fixing unit 106 to the discharging portion. The temperature-detecting means detects the temperature of the non-image-formed surface (that may also be referred to as a non-printing surface) of the printing material P that is discharged from the heat-fixing unit 106.

The advantages of detecting the temperature of a non-printing surface include, for example, the following two points. The first point is that the effect due to the attachment of the toner to the heat-collecting plate can be avoided. In other words, in normal one-side printing, because the surface, of the printing material, that is different from the surface on which the toner is fixed (i.e., non-printing surface) contacts with the heat-collecting plate, the toner hardly attaches to the heat-collecting plate; therefore, the deterioration in temperature-detecting accuracy, due to toner, can be avoided. The second point is that the properties of a printing material can be anticipated through the detected temperature. That is to say, thermal energy is applied from the heating body 203 to the printing material P via the fixing film 202, and the heat is transferred from the printing surface to the non-printing surface, of the printing material; therefore, by detecting the temperature of the non-printing surface, the difference in the properties of temperature gradients due to the heat transfer can be utilized. For example, the temperature of the non-printing surface of a thin printing material is higher than that of a thick printing material. The temperature difference also enables the determination of types of printing materials.

(Configuration of Temperature-Detecting Means)

A fixing-discharging guide 208 that forms a printing-material transporting path is provided between the fixing nip portion N and the discharging-roller nip portion. The fixing-discharging guide 208 is made up of a material having high heat resistance, such as PBT and PET. The transporting plane of the fixing-discharging guide 208 is determined below a line A (in FIG. 3) that connects the fixing nip portion N with the discharging-roller nip portion. In addition, the transport speed for a printing material at the discharging roller 206 is determined to be higher than that at the fixing nip portion N, so that the printing material does not directly contacts with the transporting plane of the fixing-discharging guide 208, when the printing material passes.

The fixing-discharging guide 208 is equipped with the printing-material discharge sensor for detecting whether or not there is the printing material P that passes through the heat-fixing unit 106. The printing-material discharge sensor is made up of a discharge-sensor lever 209 and a photointerrupter 210. The discharge-sensor lever 209 is made mainly of a high-slidability plastic material such as polyacetal; the front edge thereof, i.e., a printing-material passage portion is disposed in a position where the line A that connects the fixing nip portion N with the discharging-roller nip portion is interrupted. The discharge-sensor lever 209 is configured in such a way that, when a printing material passes, the discharge-sensor lever 209 leans toward the direction of paper transportation (FIG. 4), and that the interrupting portion of the discharge-sensor lever 209 cuts off an infrared ray from the photointerrupter 210. In the case where there is no printing material, the discharge-sensor lever 209 returns to a home position, and the interrupting portion comes to a position where the interrupting portion does not interrupts the infrared ray from the photointerrupter 210 (FIG. 2). As described above, whether or not there is a printing material is detected, by switching ON/OFF the infrared ray from the photointerrupter 210, based on the movement of the discharge-sensor lever 209.

Figure 6:
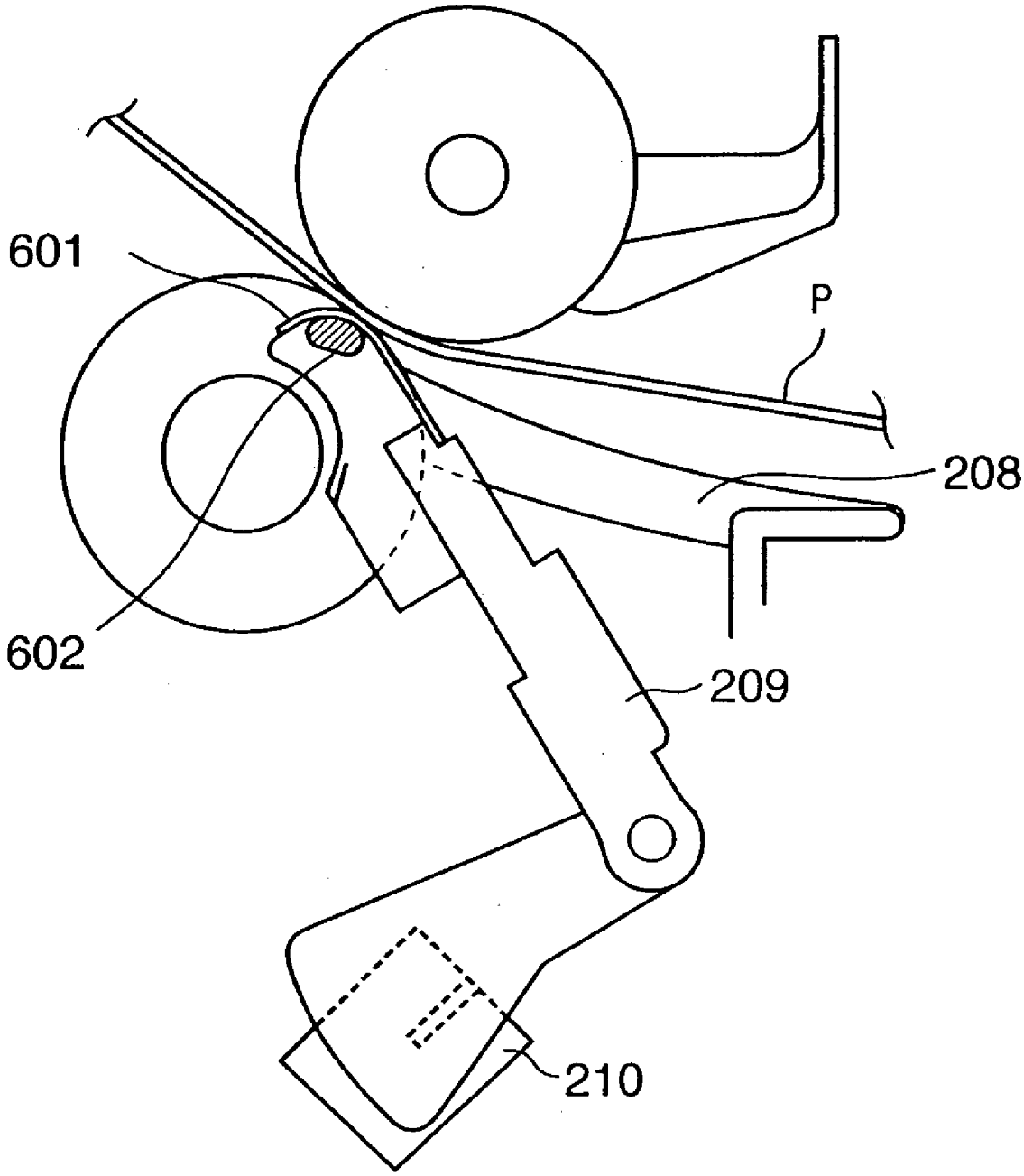
FIG. 6 is a detailed view illustrating the discharge-sensor lever 209 according to First Embodiment and its vicinity.

FIG. 6 is a detailed view illustrating the discharge-sensor lever 209 according to First Embodiment and its vicinity. In the printing-material passage portion situated on the front edge of the discharge-sensor lever 209, a heat-collecting plate 601 as a heat-collecting material is provided. The heat-collecting plate 601 may be constituted integrally with the discharge-sensor lever 209, by means of outsert molding or the like. The heat-collecting plate 601 is made of a small-heat-capacity material, such as aluminum or stainless steel, that is a thin plate having a thickness of approximately 0.1 mm. Moreover, the heat-collecting plate 601 is biased, by biasing means (unillustrated) such as a spring, in such a way as to abut on the non-printing surface of the printing material P that is discharged from the heat-fixing unit 106.

The heat-collecting plate 601 is disposed above the line A (in FIG. 3) that connects the fixing nip portion N with the discharging-roller nip portion. The front edge of the printing material P that has passed through the fixing nip portion N firstly contacts with the plastic portion of the discharge-sensor lever 209. When the printing material P is further transported downward, the discharge-sensor lever 209 pivots counterclockwise, and, then, the heat-collecting plate 601 abuts on the non-printing surface of the printing material P. As described above, by making the heat capacity of the heat-collecting plate 601 be small and positively abut on the printing material P, it is possible to make in a short time the temperature of the heat-collecting plate 601 approximately the same as that of the printing material P. In this situation, in order to diminish the heat capacity of the heat-collecting plate 601, it is preferable that the heat-collecting plate 601 is situated approximately perpendicular to the transport direction of the printing material P, and that the length, of the heat-collecting plate 601, in the direction approximately in parallel with the transversal direction of the printing material P is as small as possible. However, it goes without saying that a size as large as to maintain the original object of the heat-collecting plate 601 is ensured.

In the case where both-side printing is implemented, while the second surface of the printing material P passes, the heat-collecting plate 601 on the discharge-sensor lever 209 contacts with the first printing surface of the printing material P; therefore, there is anxiety that toner attaches onto the surface of the heat-collecting plate 601. As a countermeasure against the anxiety, surface treatment such as coating with fluoride resin and UV (anti ultraviolet ray) painting may be applied to the surface of the heat-collecting plate 601. It is preferable that the surface treatment is implemented to the extent that the heat conductivity of the heat-collecting plate 601 is affected as little as possible. For example, the surface treatment may be to the extent that accuracy in detecting the temperature of a discharged printing material and control of fixing temperature are not significantly affected. As a specific example, it is conceivable that the thickness of 20 μm or less, of the surface treatment or the coating, has little effect on the heat conductivity. In addition, in order to protect the heat-collecting plate 601, coating with PI (polyimide) or the like may be applied to the surface thereof.

A temperature-detecting sensor 602 is attached, through bonding or the like, to the back side of the heat-collecting plate 601 disposed on the front edge of the discharge-sensor lever 209. It is desirable that the temperature-detecting sensor 602 is a sensor having relatively high responsiveness, such as a thermistor. When the printing material P on which image-fixing processing has been implemented arrives being transported from the heat-fixing unit 106, the discharge-sensor lever 209 pivots; the heat-collecting plate 601 abuts on the non-printing surface of the printing material P, thereby absorbing the heat of the printing material P; the heat-collecting plate 601 transfer the heat to the temperature-detecting sensor 602 disposed on the back side thereof; in consequence, the temperature-detecting sensor 602 detects the heat of the printing material P. The temperature-detecting sensor 602 is disposed on the back side of the heat-collecting plate 601, in such a way as to be situated immediately below the position (abutting portion) where the heat-collecting plate 601 and the printing material P abut on each other. The abutting portion is a position where the printing material P and the heat-collecting plate 601 abut on each other, when the discharge-sensor lever 209 starts to pivot, i.e., when the discharge-sensor lever 209 detects the existence of the printing material P.

As discussed above, by disposing the temperature-detecting sensor 602 immediately below the abutting portion, the effect of a temperature gradient within the heat-collecting plate 601 can be minimized; in consequence, the accuracy in detecting the temperature of the printing material P can be enhanced. In addition, by utilizing a metal material for a sliding portion where discharge-sensor lever 209 and the printing material P slide on each other, the wear and tear on the sliding portion can be prevented, whereby the durability of the discharge-sensor lever 209 can be raised.

In the case of detecting by a thermistor the temperature of a printing material being transported, because the heat-collecting plate accumulates heat, the more posterior the position of the printing material is, the higher the detected temperature is likely to be. For that reason, if the measurement point differs for each printing material, the detected temperature fluctuates, whereby even the same type of printing materials may be determined as different types of printing materials. Therefore, it is preferable that, every time the temperature of a discharged printing material is measured, the measurement is implemented at the same position.

In this regard, by disposing the heat-collecting plate 601 and the temperature-detecting sensor 602 such as a thermistor on the discharge-sensor lever 209 that detects whether or not the printing material P exists, the positional information and the temperature information of a printing material can accurately be synchronized. In other words, which position in the printing material the temperature information outputted by the thermistor is for can accurately be detected. For example, by counting through a CPU the elapsed time from the detection, by the printing-material discharge sensor, of the front edge of the printing material P, and by detecting the temperature information at the timing when a predetermined time has elapsed, the temperature information for each printing material is obtained always in approximately the same position. In this situation, assuming that the transport speed for a printing material is constant, the predetermined time is proportional to the distance from the front edge (positional information); therefore, by making the predetermined time constant, the same position can be specified for each printing material. As described above, by synchronizing the temperature information with the positional information for the printing material P, the temperature of a discharged printing material can more stably be detected.

It is known that the temperature detected by means of the temperature-detecting sensor 602 (may be referred to as discharged-paper-temperature detecting means) disposed on the discharge-sensor lever 209 is affected by the type of the printing material P that is transported to the fixing nip portion N. It is an object of First Embodiment to prevent defective images such as a hot-offset and to obtain stable fixing performance regardless of the type of a printing material, by appropriately and automatically changing fixing conditions in response to the detected temperature.

The transition of temperature detected through the discharged-paper-temperature detecting means and the sequence based on the detected temperature, according to First Embodiment, in the case where toner images on various types of printing materials P were heat-fixed, will be explained below.

(Sequence Based on the Discharged-Paper-Temperature Detecting Means)

The image-forming apparatus utilized is a laser-beam printer having a paper-transport speed (processing speed) of 320 mm/sec, and can print 55 sheets of letter-size printing materials per minute. The heat-fixing unit 106 was constituted as follows: A heater for heating was formed by screen-printing on an AlN substrate of 0.6 mm in thickness and 12 mm in width an electroconductive heating element formed with Ag/Pd paste. A fixing film was pivotally situated on the sliding surface of the heater. As the heater, a heating material was utilized that was formed by sequentially coating the surface of a SUS304 seamless metal film of 30 mm in outside diameter and 40 μm in thickness, as a base layer, with a primer layer of 4 μm in thickness, and a resistance-adjusted fluoride resin layer of 10 μm in thickness. In addition, the pressure roller was made up of an aluminum core metal of 22 mm in diameter, electroconductive silicon rubber provided, as an elastic layer, on the surface of the aluminum core metal, and a PFA tube with which the surface layer of the electroconductive silicon rubber was coated. The pressure force applied between the fixing material and the pressure roller was determined to be 15 kgf. The discharge-sensor lever 209 was situated at the downward side of the fixing nip portion N. On the front edge of the lever, a SUS plate of 0.1 mm in thickness, 6 mm in width, and 8 mm in height was disposed as the heat-collecting plate 601. The temperature-detecting sensor 602 was disposed on the back side of the heat-collecting plate 601. A small-size thermistor was employed as the temperature-detecting sensor 602. The heat-sensitive portion of the thermistor was fixed being bonded through an epoxy-based adhesive to the heat-collecting plate 601.

With the foregoing constitution, the relationship between the detected-temperature transition, and the occurrence of a hot-offset or defective fixing was studied, by continually printing on various types of printing materials, while keeping a constant fixing temperature. In other words, with regard to a comparative example to which dynamic fixing-temperature adjustment is not applied, the transition of temperature of a discharged printing material was studied. In this case, the continual printing means printing operation in which such a situation is continued that, at the timing when the rear end of a printing material on which heat-fixing has been applied passes through the discharge-sensor lever 209, transfer of a non-fixed image onto the following printing material starts. In continual printing, images are formed, with the distance between the rear end of a preceding printing material and the front end of the following printing material (a paper space) being kept constant.

The printing materials, utilized in the experiment, included smooth-surface thin paper A having grammage of 60 g/m$^2$, thin paper B, having the grammage of 80 g/m$^2$, whose surface is slightly rougher than that of the thin paper A, and roughest-surface rough paper C having grammage of 90 g/m$^2$. All of these printing material had the letter size.

Figure 7:
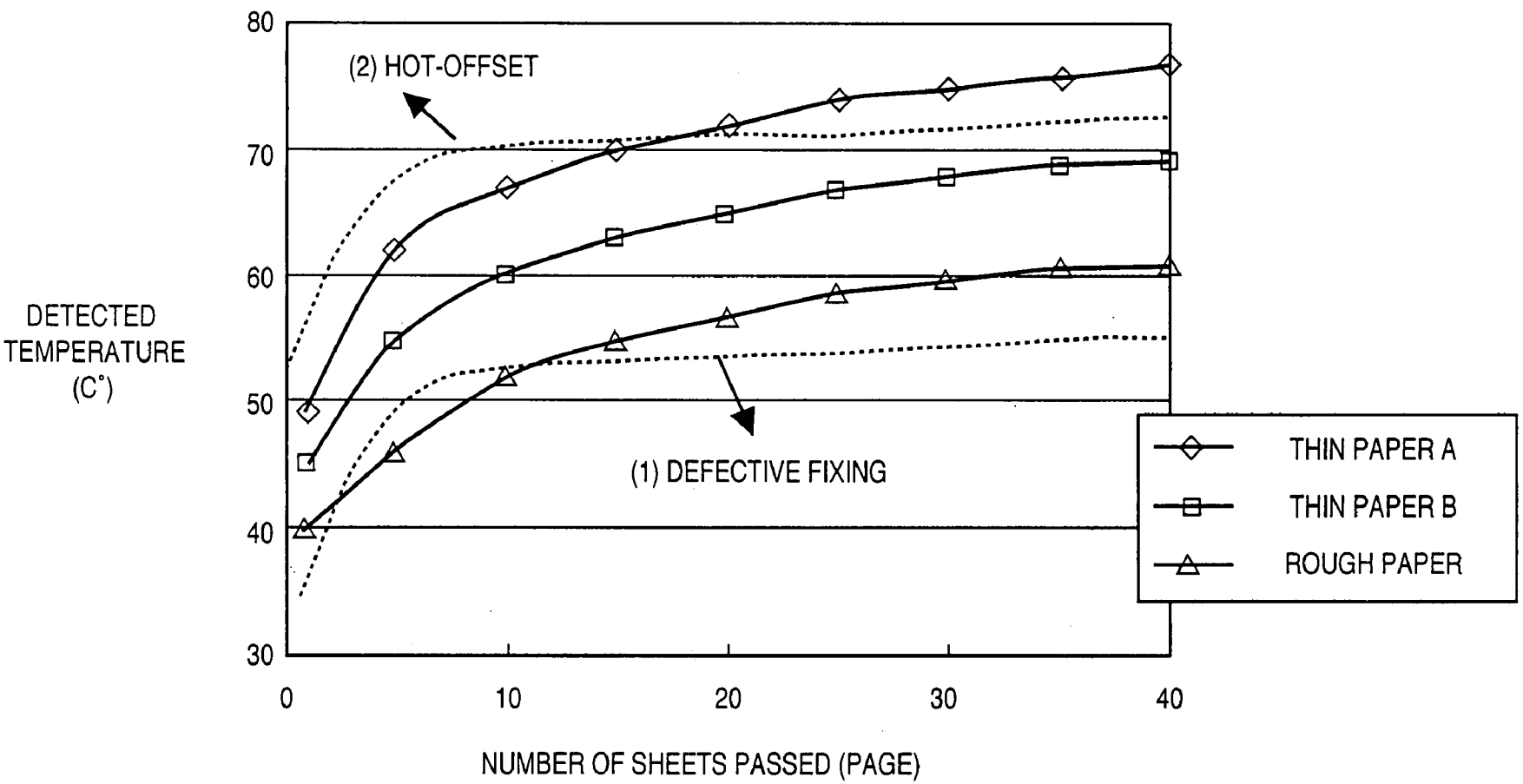
FIG. 7 is a view illustrating results of an experiment on an image-forming apparatus according to First Embodiment.

FIG. 7 is a view illustrating results of an experiment on an image-forming apparatus according to First Embodiment. In FIG. 7, the abscissa denotes the number of sheets in the case of continual printing, and the ordinate denotes the temperature detected through the discharged-paper-temperature detecting means. As is clear from FIG. 7, in the case of the smooth-surface thin paper A, the detected temperature transits in a highest-temperature zone. In the case of the thin paper B whose surface is slightly rougher, and whose grammage is slightly larger, than that of the thin paper A, the detected temperature transits in a zone slightly lower than the highest-temperature zone. In the case of the roughest-surface rough paper C, it can be seen that the detected temperature transits in a relatively low-temperature zone. This is because the difficulty in obtaining adhesiveness of a heating material to the fixing film is proportional to the roughness of the surface of a printing material. In other words, heat transferability from the surface of the fixing film to the printing material P is deteriorated. Moreover, a thick printing material has large heat capacity; thus, even though the surface is smooth, the temperature of the non-printing surface does not readily rise. Still moreover, if the detected temperature exists below the broken line (1), defective fixing occurs; if the detected temperature exists above the broken line (2), a hot-offset occurs. Therefore, by controlling the amount of the heat that is transferred from the heating material to the printing material, in such a way that the detected temperature is above the broken line (1) and below the broken line (2), the hot-offset can be prevented, and, at the same time, sufficient fixing ability can be obtained.

Figure 8:
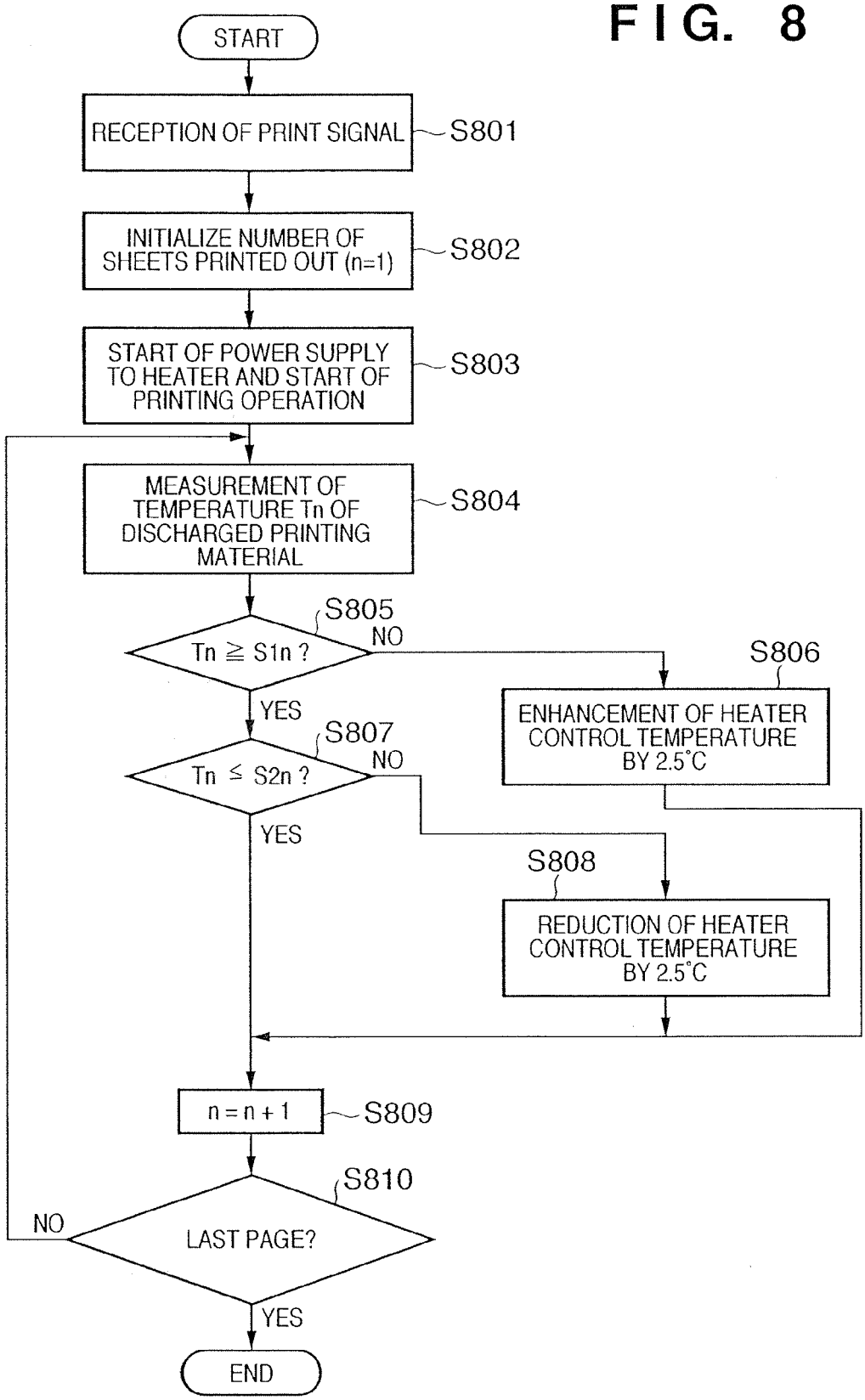
FIG. 8 is a flowchart illustrating an example of a fixing-temperature adjustment sequence based on the discharged-paper temperature detecting means according to First Embodiment.
Figure 9:
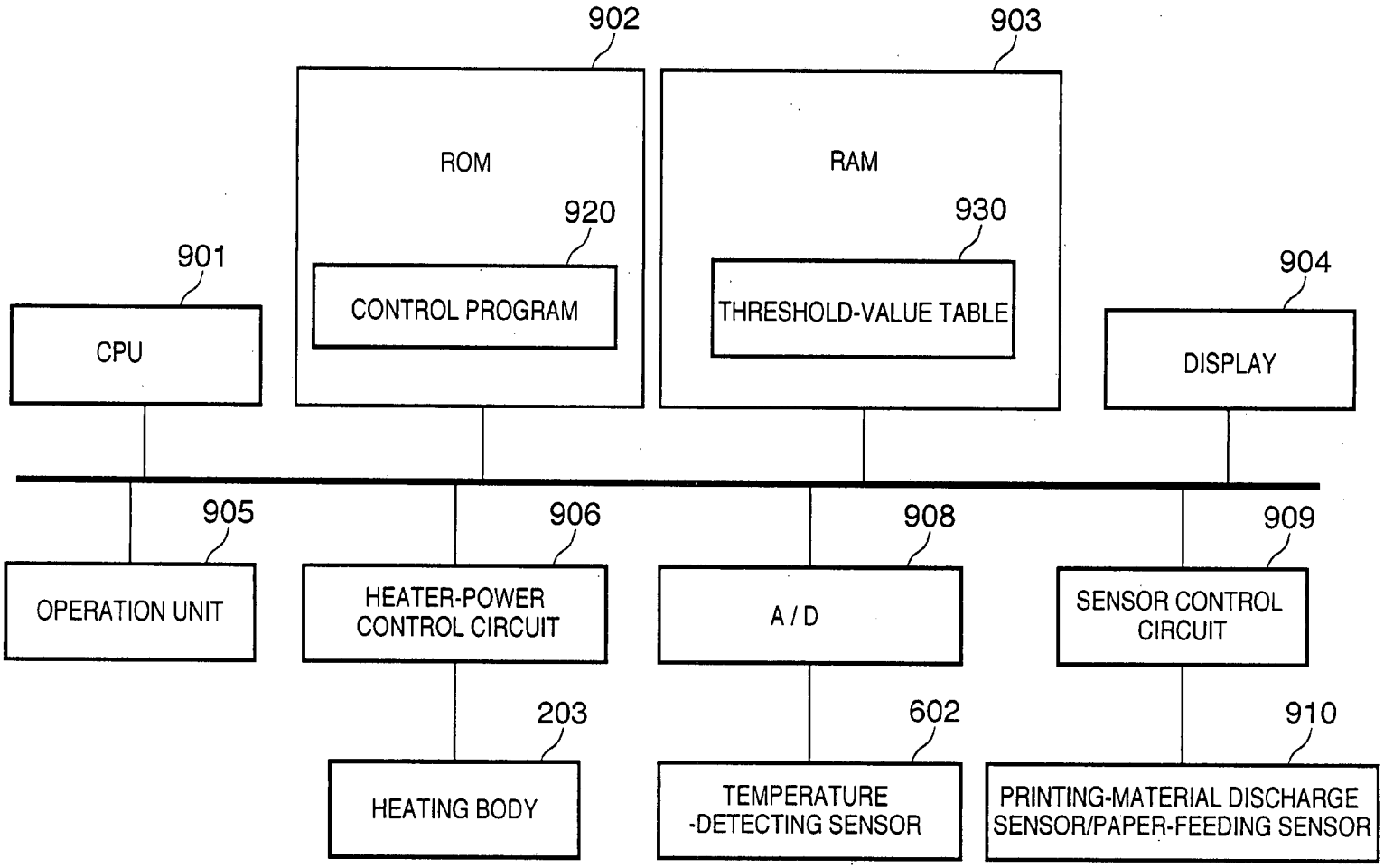
FIG. 9 is a block diagram illustrating the control unit of an image-forming apparatus according to First Embodiment.

FIG. 8 is a flowchart illustrating an example of a fixing-temperature adjustment sequence based on the discharged-paper-temperature detecting means according to First Embodiment. FIG. 9 is a block diagram illustrating the control unit of an image-forming apparatus according to First Embodiment. The control unit includes a central processing unit (CPU) 901 for integrally controlling the entire image-forming apparatus, according to a control program 920 stored in a memory (ROM) 902, the nonvolatile memory ROM 902, a readable and writable memory (RAM) 903 for storing a threshold-value table 930 and the like, a display unit 904 made up of a liquid-crystal display panel that displays operational results and the like, an operation unit 905 made up of a touch panel and key switches, a heater-power control circuit for controlling electric power supplied to the heating body 203, an A/D converter 908 for converting an analogue signal from the discharged-paper-temperature sensor 602 into a digital signal, and a sensor control circuit 909 for receiving sensor outputs from various sensors 910 such as the foregoing printing-material discharge sensor and a paper-feeding sensor and for transferring them to the CPU 901.

In the step S801, the CPU 901 receives a print signal from a personal computer, or the like, connected to the operation unit 905 or to the outside of the image-forming apparatus.

In the step S802, the CPU 901 sets to 1 a variable n for counting the number of sheets printed out and stores it in the RAM 903.

In the step S803, the CPU 901 transmits a power-supply command to the heater-power control circuit 906. The heater-power control circuit 906 starts to supply the heater included in the heating body 203 with electric power. Thereafter, the CPU 901 drives the beam unit 102, the photoconductive drum 100, and various types of transport mechanisms, thereby starting the printing operation. The printing material P is fed by a paper feeder; then, in the image-forming portion, image-forming operation is implemented.

In the step S804, when recognizing through the sensor control circuit 909 that discharging of paper has been detected by the printing-material discharge sensor 910, the CPU 901 obtains through the A/D converter 908 the temperature Tn, of a discharged printing material, detected by the discharged-paper-temperature sensor 602. In other words, the temperature T1 of the discharged printing material P is measured by the foregoing discharged-paper-temperature detecting means.

In the step S805, the CPU 901 obtains the threshold value S1*n*, by referring to the threshold-value table 930, and determines whether or not the detected temperature Tn of the discharged printing material is the threshold value S1*n* or larger. The threshold value S1*n* is a temperature threshold value for preventing defective fixing. When n is 1, whether or not T1 is S11 or larger is determined. If the determination result indicates that the temperature Tn of the discharged printing material is the threshold value S1*n* or larger, the CPU 901 proceeds to the step S807. In contrast, if the determination result indicates that the temperature Tn of the discharged printing material is the threshold value S1*n* or smaller, the CPU 901 proceeds to the step S806, and then transmits to the heater-power control circuit 906 a command for raising the controlled temperature of the heater. The temperature-raising command may include information on a specific temperature rise (e.g., 2.5° C.). Alternatively, the temperature may rise by a predetermined temperature per temperature-raising command. Although the former is more complex in terms of the configuration, it has an advantage of enabling high-speed control. The heater-power control circuit 906 enhances power supply to the heating body 203, in response to the temperature-raising command.

FIG. 10 is a view representing an example of a threshold-value table according to First Embodiment. In this example, threshold values S1 and S2 are stored being related to each other, for each number n of sheets to be printed out. The CPU 901 reads out respective threshold values, in the threshold-value table 930, for the number n of sheets being currently processed.

In the step S807, the CPU 901 obtains the threshold value S2*n*, by referring to the threshold-value table 930, and determines whether or not the detected temperature Tn of the discharged printing material is the threshold value S2*n* or smaller. The threshold value S2 is a temperature threshold value for preventing a hot-offset. When n is 1, whether or not Tn is S2*n* or smaller is determined. If the determination result indicates that the temperature Tn of the discharged printing material is the threshold value S2*n* or smaller, the CPU 901 proceeds to the step S809. In contrast, if the determination result indicates that the temperature Tn of the discharged printing material is larger than the threshold value S2*n*, the CPU 901 proceeds to the step S808, and then transmits to the heater-power control circuit 906 a command for reducing the controlled temperature of the heater. The temperature-reducing command may include information on a specific temperature reduction (e.g., 2.5° C.). The heater-power control circuit 906 reduces power supply to the heating body 203, in response to the temperature-reducing command. In addition, it is assumed that the predetermined threshold values are in a relationship in which S1*n* is smaller than S2*n*.

In the step S809, the CPU 901 adds 1 to the variable n for counting the number of sheets printed out and stores the sum in the RAM 903.

In the step S810, the CPU 901 determined through the print-number variable n whether or not image forming for the last page has been completed. If the image forming for the last page has not been completed, the CPU 901 returns to the step S804 and measures the temperature T (n+1) of a discharged printing material. If the image forming for the last page has been completed, the CPU 901 ends processing related to the present flowchart.

In First Embodiment, raising or reducing a constant value (e.g., 2.5° C.) in controlling the heater temperature has been explained; however, the value can dynamically be changed. For example, the CPU 901 may determine the temperature to be changed, in such a way that the temperature to be changed is proportional to the difference between the threshold-value temperature and the detected temperature.

In First Embodiment, the threshold value is determined for each printing material (the number of sheets printed out); however, the threshold value may be determined every predetermined time. In terms of the resultant properties, it is preferable to determine the threshold value print by print; therefore, the predetermined time may be duration required for printing on a single printing material. The duration—differs depending on the type of an apparatus and a throughput—may be, for example, in a range of one to 10 seconds.

FIG. 11 is a view illustrating results of experiments for confirming effects, of the present invention, according to First Embodiment. In other words, by carrying out respective experiments on image forming, with the temperature of the heater being controlled through the discharged-paper-temperature detecting means according to First Embodiment, and on image forming, with a constant fixing temperature (comparative example), the both types of image forming were compared, with regard to hot-offsets and fixing performances. As for the threshold-value temperatures S1 and S2 according to First Embodiment, the values represented in FIG. 10 were used. The printing materials used in the experiments included the foregoing thin paper A, thin paper B, and rough paper C. Fifty sheets each of the above types of paper were passed. In particular, FIG. 11 represents the results of comparison between First Embodiment and the comparable example, with regard to the number of sheets having hot-offsets and the number of sheets having image loss due to defective fixing.

It was found, from the above experiments, that, because it has become possible to accurately measure the temperature of a discharged printing material, the appropriate adjustment of the fixing temperature, corresponding to the type of the printing material, has become possible. Accordingly, in First Embodiment, sufficient fixing ability could be obtained, while preventing hot-offsets. In contrast, in the case of the comparative example, hot-offsets and defective fixing occurred, depending on the type of a printing material (with the thin paper A, the hot-offset occurred in 32 out of 50 sheets; with the rough paper C, the defective fixing occurred in 8 out of 50 sheets).

As described above, according to First Embodiment, by disposing a low heat-capacity temperature-detecting sensor, immediately after the fixing nip portion and at the side of non-printing surface, by comparing the temperature of a discharged printing material with a predetermined threshold-value temperature, and by automatically implementing heat-fixing suitable for each printing material, the defects such as a hot-offset and defect fixing can be reduced.

In addition, the discharged-paper-temperature sensor 602 is disposed on a portion, of the printing-material discharge sensor, where a printing material abuts on the printing-material discharge sensor; in consequence, the temperature sensor becomes insusceptible to steam, whereby the image-forming apparatus can more appropriately control the fixing temperature than conventional image-forming apparatuses. In other words, the image-forming apparatus can more reduce the incidence rate of defects, such as increase, due to excess heating, in the amount of hot-offsets and curls, deterioration of loading capacity, and defective fixing due to scarcity of the amount of heat, than the conventional image-forming apparatuses. In addition, by synchronizing the detection of printing-material discharge with the detection of the temperature of the discharged printing material, the accuracy in measurement of the temperature of the discharged printing material can be enhanced.

Moreover, by determining a threshold temperature every time when a printing material passes through a heat-fixing unit 106, a problem can be addressed, in which, at the beginning of a series of paper passage, the amount of fluctuation in detected temperature becomes significantly large.

Still moreover, the heat-collecting plate 601 is disposed on the portion, of the printing-material discharge sensor, where a printing material abuts on the printing-material discharge sensor; the discharged-paper-temperature sensor 602 is disposed on the back surface of a portion, of the heat-collecting plate 601, where the heat-collecting plate 601 abuts on the printing material P, in such a way that the discharged-paper-temperature sensor 602 is immediately below the abutting portion. Accordingly, effects of a temperature gradient within the heat-collecting material can be reduced; therefore, the accuracy in measuring of the temperature of a discharged printing material is enhanced, whereby the control of the fixing temperature becomes suitable. Furthermore, by means of a structure in which the heat-collecting material is interposed, the durability of the printing-material discharge sensor can be raised.

Moreover, by forming an adhesion-restraining coating on the surface, of the heat-collecting material 601, that abuts on a printing material, to the extent that the coating does not adversely affect the detecting accuracy of the discharged-paper-temperature sensor 602, adhesion of toner can be prevented, and the adverse effect, related to an detection error, on the discharged-paper-temperature sensor 602 could be limited to a minimum.

In the foregoing embodiment, the fixing control is implemented by utilizing the temperature at one point on a printing material; however, by detecting the temperature, of a discharged printing material, at one or more points, the fixing control may be implemented, based on a plurality of temperatures on a discharged printing material. In other words, the CPU 901 adjusts the fixing temperature, by utilizing a plurality of temperatures, on a discharged printing material, that are each detected, by the discharged-paper-temperature sensor 602, at a plurality of positions on the printing material P that is detected by the printing-material discharge sensor. For example, the temperature, of a discharged printing material, at the front edge differs from that at the rear end; therefore, the fixing temperature may be adjusted by selecting the temperature, of a discharged printing material, at a more appropriate position, or by utilizing a calculated value (e.g., an average value) of a plurality of temperatures on a discharged printing material.

In addition, by determining a threshold value for each printing material or every predetermined time, and by comparing the determined threshold value with the temperature of a discharged printing material, the CPU 901 may implement the control, in such a way as to reduce the amount of heat of the heat-fixing unit 106, when the temperature of the discharged printing material is the determined threshold value or higher, and to enhance the amount of heat of the heat-fixing unit 106, when the temperature of the discharged printing material is lower than the determined threshold value. Accordingly, the incidence rates of a hot-offset and defective fixing could be reduced.

Second Embodiment

Second Embodiment proposes a technology for controlling the fixing temperature, in consideration also of the parameters (such as room temperature and humidity) of an environment in which an image-forming apparatus is installed.

In general, the temperature of printing materials piled in a paper-feeding tray is kept at a temperature close to that of an environment in which an image-forming apparatus is situated. Even though the heating conditions of the heat-fixing unit 106 are constant, the temperature in the vicinity of heat-fixing unit may vary, depending on an environment in which the image-forming apparatus is installed, for example, due to effects of convection and the like. Therefore, the temperature detected by the discharged-paper-temperature detecting means, in the case where the temperature of an environment in which the image-forming apparatus is installed is low, differs from that in the case where the temperature of the environment is high.

Figure 12A:
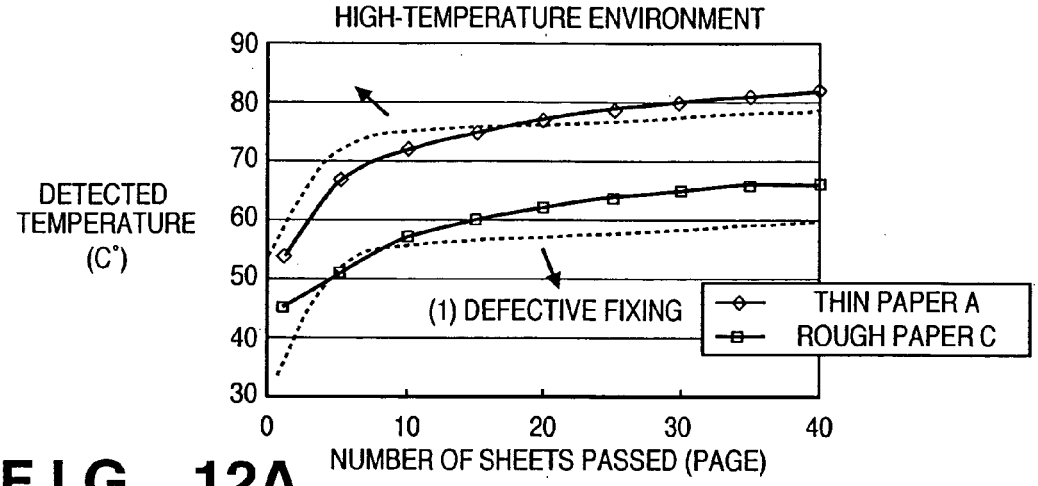
FIGS. 12A-12C are graphs for explaining change in fixing performance, for each type of printing material, due to difference in environmental parameter.
Figure 12B:
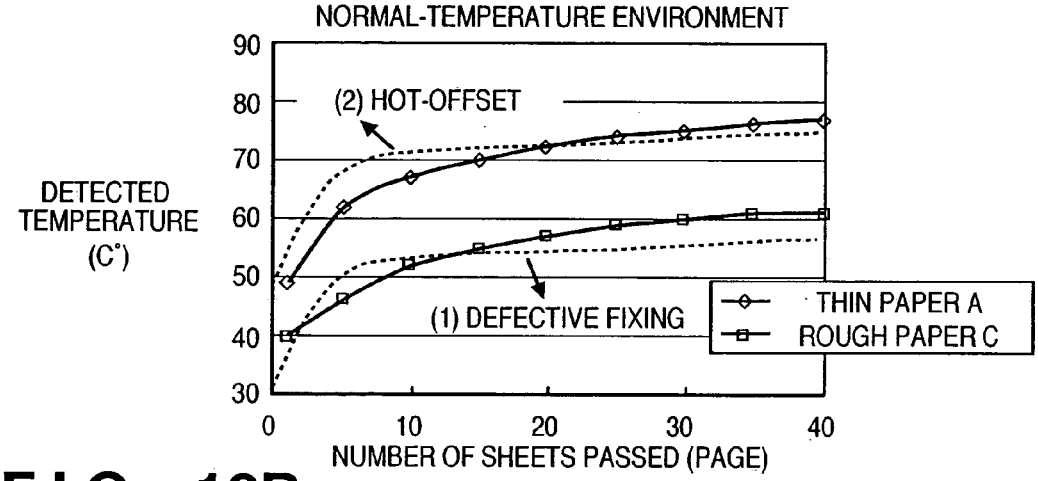
Figure 12C:
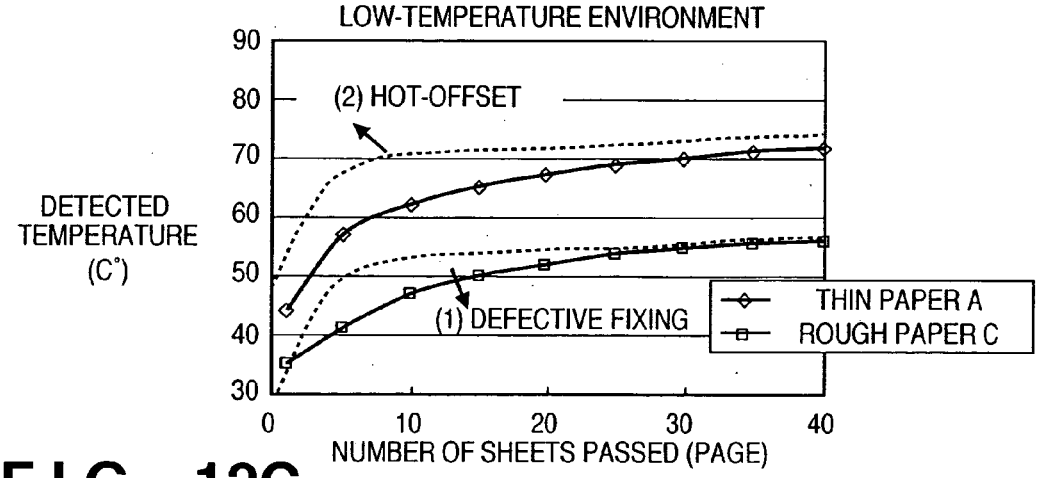

FIGS. 12A-12C are graphs for explaining change in fixing performance, for each type of printing material, due to difference in environmental parameter. With regard to the thin paper A and the rough paper C utilized in First Embodiment, by implementing continual printing in each of a high-temperature environment (at room temperature of 30° C. or higher), a normal-temperature environment (at room temperature of 20° C. to 30° C.), and a low-temperature environment (at room temperature of 20° C. or lower), the respective transitions of temperature detected by the discharged-paper-temperature detecting means were measured.

As can be seen in FIG. 12A, because the image-forming apparatus is installed in the high-temperature environment, the temperature of printing materials in the paper-feeding tray is close to the environmental temperature; thus, the temperatures detected by the discharged-paper-temperature detecting means are also high. As can be seen in FIGS. 12B and 12C, because, also in the normal-temperature environment and the low-temperature environment, the respective temperatures of printing materials in the paper-feeding tray are close to the environmental temperatures; thus, the lower the environmental temperature is, the lower the temperature detected by the discharged-paper-temperature detecting means transits. In addition, the temperature zone in which a hot-offset or defective fixing occurs varies depending on the environment; therefore, in carrying out heater-temperature control through the discharged-paper-temperature detecting means, it is necessary to determine a threshold-value temperature suitable for each environment.

In consideration of the above facts, Second Embodiment proposes a method of changing a sequence of heater-temperature control through the discharged-paper-temperature detecting means, depending on an environment in which an image-forming apparatus is installed.

Figure 13:
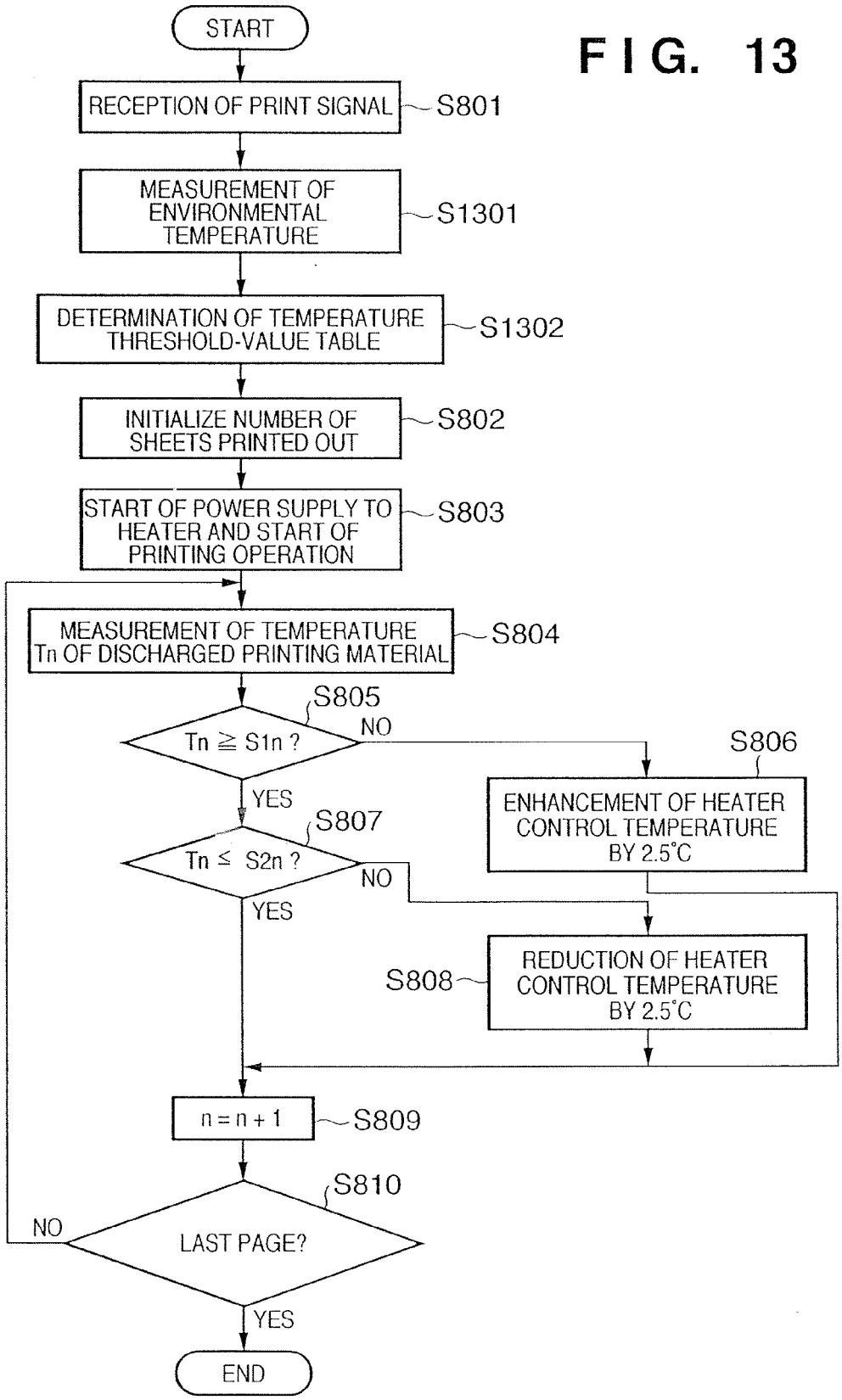
FIG. 13 is an illustrative flowchart related to adjustment and processing, of the fixing temperature, according to Second Embodiment.
Figure 14:
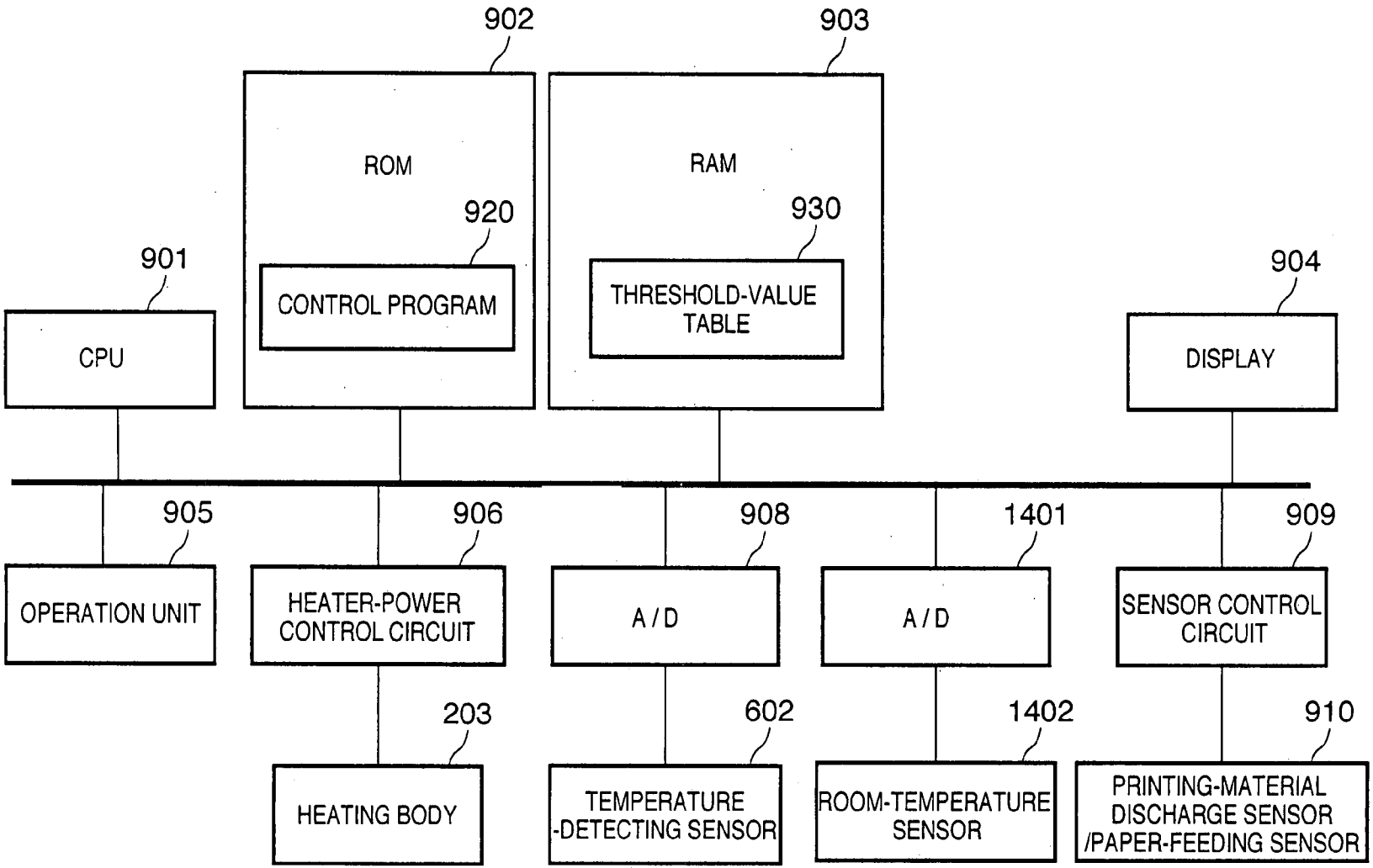
FIG. 14 is an illustrative block diagram related to the control unit of an image-forming apparatus according to Second Embodiment.

FIG. 13 is an illustrative flowchart related to adjustment and processing, of the fixing temperature, according to Second Embodiment. FIG. 14 is an illustrative block diagram related to the control unit of an image-forming apparatus according to Second Embodiment. The same constituent elements as those in First Embodiment are indicated by the same reference marks, and explanations for them will be omitted.

In the step S1301, the CPU 901 obtains through an A/D converter 1401 data on a room temperature detected by a room-temperature sensor 1402.

In the step S1302, the CPU 901 reads out a threshold-value table, corresponding to the measured room temperature, among a plurality of threshold-value tables that have preliminarily stored in the ROM 902, and stores it in the RAM 903. In the following processing, by utilizing the threshold-value table 930 that is selected, corresponding to the room temperature, the foregoing adjustment and processing of the fixing temperature are implemented.

Second Embodiment is to detect an environmental temperature at which an image-forming apparatus is installed and is to determine a threshold-value temperature based on information on the environmental temperature; however, it is known that moisture included in a printing material also affects the fixing performance. Thus, by further providing in the image-forming apparatus means for detecting environmental humidity, the threshold-value temperature may be determined base on information on the environmental humidity. In order to confirm the effect of Second Embodiment, experiments were carried out.

With regard to the case (Example) where a method, described in Second Embodiment, of determining the threshold-value table, corresponding to an environmental temperature and the case (comparative Example) where the heat-fixing is implemented by utilizing the threshold-value table only for a normal-temperature environment, experiments in respective environments (environments of 15° C., 25° C., and 35° C.) were carried out and then were each compared with one another, with regard to hot-offsets and fixing performances.

FIG. 15 illustrates a threshold-value table for a high-temperature environment. FIG. 16 illustrates a threshold-value table for a normal-temperature environment. FIG. 17 illustrates a threshold-value table for a low-temperature environment. As printing materials, the foregoing thin paper A and rough paper C were utilized. Fifty sheets were passed in the continual printing mode, and the number of printouts having a hot-offset and the number of printouts having image loss due to defective fixing were obtained. FIG. 18 is a table illustrating results of the experiments with regard to Example and Comparative Example.

From the experiments, it was confirmed that, in Second Embodiment, sufficient fixing ability can be obtained, while preventing hot-offsets in each of the environments. In contrast, in the Comparative Example where the threshold-value table only for a normal-temperature environment was utilized, hot-offsets and defective fixing occurred, depending on the environment. Specifically, in the high-temperature environment, hot-offsets occurred on 38 sheets of thin paper A; in the low-temperature environment, defective fixing occurred on 25 sheets of rough paper C.

As described above, in Second Embodiment, parameters for an environment in which an image-forming apparatus is installed are detected, and, in consideration of the detected results, threshold-value temperatures for fixing control are determined; therefore, regardless of not only the type of a printing material but also the environment in which the image-forming apparatus is utilized, ideal image forming can be realized. In other words, the incidence rates of a hot-offset and defective fixing can be reduced.

Other Embodiment

Heretofore, various embodiments have been described; the present invention may be applied to a system made up of a plurality of apparatuses, or to a stand-alone apparatus. For example, the present invention may be applied to a scanner, a printer, a PC, a copy machine, a composite apparatus, and a facsimile machine.

In addition, Second Embodiment has been explained, in which a plurality of threshold-value tables are utilized; however, for threshold values stored in a single threshold-value table, interpolation calculation may be implemented based on the environmental parameters. In other words, from a threshold-value table, other threshold-value tables may be calculated through the interpolation calculation.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-199411 filed on Jul. 6, 2004, which is hereby incorporated by reference herein.

What is claimed is:

1. An image-forming apparatus comprising:

a heat-fixing unit for heat-fixing a non-fixed image onto a printing material, said heat-fixing unit controlled so as to maintain a target temperature;

a temperature detecting sensor for detecting a temperature of the printing material discharged from said heat-fixing unit; and a temperature adjusting unit for adjusting the target temperature so that the temperature detected by the temperature detecting sensor is within a reference temperature range, the reference temperature range being variable, wherein said temperature adjusting unit sets the reference temperature range based on a number of the printing materials which are sequentially printed, and both of an upper limit and a lower limit of the reference temperature range are set higher as the number of the printing materials which are sequentially printed is increased.

2. The image forming apparatus according to claim 1, wherein said temperature adjusting unit also sets the reference temperature range according to an environmental parameter and the number of the printing materials which are sequentially printed, and both of an upper limit and a lower limit of the reference temperature range are set higher as an environmental temperature is increased.

3. An image-forming apparatus comprising:

a heat-fixing unit for heat-fixing a non-fixed image onto a printing material, said heat-fixing unit controlled so as to maintain a target temperature;

a temperature detecting sensor for detecting a temperature of the printing material discharged from said heat-fixing unit; and a temperature adjusting unit for adjusting the target temperature so that the temperature detected by the temperature detecting sensor is within a reference temperature range, the reference temperature range being variable, wherein said temperature adjusting unit sets the reference temperature range based on a number of the printing materials which are sequentially printed, and a center value of the reference temperature range is set higher as the number of the printing materials which are sequentially printed is increased.

4. The image forming apparatus according to claim 3, wherein said temperature adjusting unit also sets the reference temperature range according to an environmental parameter and the number of the printing materials which are sequentially printed, and the center value of the reference temperature range is set higher as an environmental temperature is increased.

5. The image-forming apparatus according to claim 1 or 3, wherein said heat-fixing unit comprising:

an endless belt;

a heater that abuts on an inner peripheral surface of said endless belt; and a pressure roller that forms a fixing nip portion with said heater through said endless belt, wherein said heater is controlled so as to maintain the target temperature.

6. The image-forming apparatus according to claim 1 or 3, wherein said temperature detecting sensor detects a temperature of the non-image-formed surface of the printing material.

7. The image-forming apparatus according to claim 6, wherein said temperature detecting sensor detects the temperature of the printing material when it is located between said heat-fixing unit and a conveying roller, wherein the conveying roller is located immediately downstream of said heat-fixing unit in a conveying direction of the printing material.

* * * * *

UNITED STATES PATENT AND TRADEMARK OFFICE

CERTIFICATE OF CORRECTION

PATENT NO. : 7,298,985 B2
APPLICATION NO. : 11/169787
DATED : November 20, 2007
INVENTOR(S) : Nihonyanagi et al.

It is certified that error appears in the above-identified patent and that said Letters Patent is hereby corrected as shown below:

ON THE TITLE PAGE:
At Item (56), References Cited, Foreign Patent Documents, "JP 200113816 1/2001" should read --JP 2001-13816 1/2001--.

At Item (57), Abstract, Line 10, "conventional" should read --the conventional--.

COLUMN 2:
Line 34, "can not" should read --cannot--.

COLUMN 5:
Line 67, "face," should read --face--.

COLUMN 6:
Line 30, "contacts" should read --contact--.

COLUMN 7:
Line 22, "length," should read --length--.

COLUMN 12:
Line 54, "portion," should read --portion--.

COLUMN 15:
Line 11, "base" should read --based--.

UNITED STATES PATENT AND TRADEMARK OFFICE

CERTIFICATE OF CORRECTION

PATENT NO. : 7,298,985 B2
APPLICATION NO. : 11/169787
DATED : November 20, 2007
INVENTOR(S) : Nihonyanagi et al.

It is certified that error appears in the above-identified patent and that said Letters Patent is hereby corrected as shown below:

COLUMN 16:
Line 39, "image forming" should read --image-forming--.

Signed and Sealed this

Twelfth Day of August, 2008

JON W. DUDAS
*Director of the United States Patent and Trademark Office*